United States Patent [19]

Symons

[11] 4,200,820

[45] Apr. 29, 1980

[54] HIGH POWER ELECTRON BEAM GYRO DEVICE

[75] Inventor: Robert S. Symons, Los Altos, Calif.

[73] Assignee: Varian Associates, Inc., Palo Alto, Calif.

[21] Appl. No.: 921,136

[22] Filed: Jun. 30, 1978

[51] Int. Cl.[2] ..... H01J 25/00

[52] U.S. Cl. ..... 315/4; 313/421; 315/5.24; 315/5.39; 315/5; 315/39.53

[58] Field of Search ..... 315/5.39, 39.53, 3, 315/4, 5, 5.24, 5.26; 313/421, 423

[56] References Cited

U.S. PATENT DOCUMENTS

| | | | |
|---|---|---|---|
| 3,310,704 | 3/1967 | Symons et al. | 315/5.38 X |
| 3,392,303 | 7/1968 | Wolff et al. | 315/5.39 |
| 3,700,952 | 10/1972 | Nation | 315/5.39 |
| 3,866,085 | 2/1975 | James | 315/5.38 |
| 3,916,239 | 10/1975 | Friedlander | 315/5.39 |
| 4,019,088 | 4/1977 | Budker et al. | 315/5.26 |

*Primary Examiner*—Saxfield Chatmon, Jr.
*Attorney, Agent, or Firm*—Stanley Z. Cole; Keiichi Nishimura; Peter J. Sgarbossa

[57] ABSTRACT

A high power gyro device includes a source of electrons. The electrons from this source are formed into a beam in which individual electrons are made to follow helical paths by a DC magnetic field. The angular velocity of the beam electrons is modulated as the beam passes through an oscillating electric field in a resonant cavity or waveguide so that a high power electromagnetic wave is established in the region as a result of an interaction between the beam and field. A collector for the beam is positioned on the axis, while an output waveguide for the wave is positioned at right angles to the axis. Upstream of the collector, the wave is reflected to the output waveguide by a reflecting surface having an aperture for passing the electron beam to the collector.

18 Claims, 4 Drawing Figures

HIGH POWER ELECTRON BEAM GYRO DEVICE

FIELD OF THE INVENTION

The present invention relates generally to high power gyro devices, such as gyrotrons, gyroklystrons, and gyro travelling wave tubes, and more particularly to a high power gyro device wherein a high power wave established in a cavity or waveguide is deflected away from the common axis of the wave and a hollow electron beam, and the beam travels along the axis to a beam collector.

BACKGROUND OF THE INVENTION

High power gyro devices, such as gyrotrons, gyroklystrons and gyro travelling wave tubes, are microwave vacuum tubes based on interaction between a helical electron beam having angular velocities and an electromagnetic field. The angular velocities are imposed by a DC magnetic field and are modulated as the beam passes through an oscillating electric field of a cavity or waveguide so that a high power electromagnetic wave is established in the region as a result of an interaction between the beam and field. The wave and beam travel along the same longitudinal axis while they are in the region. The periodic interaction between the beam and the field enables the beam and microwave circuit dimensions to be relatively large compared to a wavelength, whereby power density problems encountered in conventional millimeter wavelength travelling wave tubes and klystrons are avoided. The gyro devices are capable of developing extremely high, continuous wave power, such as 200 kilowatts, at millimeter wave frequencies, such as 28 GHz. Prior art references disclosing various facets of high power gyro devices are:

- V. A. Flyagin et al., "The Gyrotron," IEEE Trans. MTT-25, No. 6, pp. 514–521, June 1977.
- J. L. Hirshfield and V. L. Granatstein, "The Electron Cyclotron Maser—An Historical Survey," IEEE Trans. MTT-25, No. 6, pp. 522–527, June 1977.
- N. I. Zaytsev, T. B. Pankratova, M. I. Petilin, and V. A. Flyagin, "Millimeter and Submillimeter Waveband Gyrotrons," Radiotekhnika i Elektronika, Vol. 19, No. 5, pp. 1056–1060, 1974.
- V. L. Granatstein, P. Sprangle, M. Herndon, R. K. Parker and S. P. Schlesinger, "Microwave Amplification with an Intense Relativistic Electron Beam," Journal of Applied Physics, Vol. 46, No. 9, pp. 3800–3805, Sept. 1975.
- P. Sprangle and A. T. Drobot, "The Linear and Self-Consistent Nonlinear Theory of the Electron Cyclotron Maser Instability," IEEE Trans. MTT-25, No. 6, pp. 528–544, June 1977.
- R. S. Symons and H. R. Jory, "Small-signal Theory of Gyrotrons and Gyroklystrons," 7th Symposium on Engineering Problems of Fusion Research, 1 Knoxville, TN, Oct. 1977.
- H. R. Jory, F. I. Friedlander, S. J. Hegji, J. F. Shively, and R. S. Symons, "Gyrotrons for High Power Millimeter Wave Generation," 7th Symposium of Engineering Problems of Fusion Research, Knoxville, TN, Oct. 1977.

In the prior art, it has been the practice to extract the millimeter wave energy coaxially with the beam axis. Hence, it is necessary for the millimeter wave energy to pass through an electron beam collector region prior to being supplied to an output waveguide of the high powered gyro device. However, when a continuous wave high power gyro device is operated so that 200 kilowatts are extracted from the millimeter wave, a collector for the electron beam must have a relatively large surface area. If the collector does not have a significant surface area, the electron beam power causes collector overheating, and possible destruction thereof. To achieve the large collector surface area, the collector must have a relatively large diameter. The wave must pass through the large diameter collector. To couple the wave to an output waveguide, it is necessary to have a tapered waveguide transition down to a smaller diameter, cylindrical output waveguide. The tapered waveguide transition to the cylindrical output waveguide causes higher order mode resonances in the collector. The portion of the millimeter wave power converted by the tapered waveguide to higher order electromagnetic modes cannot propagate in the output waveguide. Because these higher modes cannot propagate in the output waveguide, they become trapped in the collector vicinity. Resonances of the trapped modes in the collector vicinity occur as a function of frequency and collector dimensions. The resonances produce strong microwave reflections into the interaction region which interfere with the conversion of energy from the electron beam to the electromagnetic fields. Because of the limitations on the size of collectors which could be used on gyro devices as a result of the aforementioned problem with reflections, gyro devices have heretofore been limited to average power output in the order of several tens of kilowatts.

BRIEF DESCRIPTION OF THE INVENTION

In accordance with the present invention, the problems with the prior art are avoided with a reflecting surface that deflects the wave upstream of the collector so that the wave propagates away from the common axis of the wave and the helical electron beam. The wave reflecting surface includes an aperture which enables the beam to continue to travel along its propagation axis to the collector. The wave is deflected away from the axis to an output waveguide that is preferably positioned at right angles to the common beam and wave axis. Thereby, the output waveguide is physically removed from the collector and the millimeter wave energy bypasses the collector altogether.

Preferably, the structure for reflecting the electromagnetic wave, to minimize losses, is similar to that disclosed by Marcatili et al in an article entitled "Bandpass Splitting Filter", Bell Systems Technical Journal, vol. 40, p. 197 (1961). The structure disclosed in the Marcatili et al article is, however, modified so that it includes an electron beam propagating aperture in the reflecting surface.

To prevent millimeter wave energy from being coupled through the aperture of the surface, and thereby assure that virtually all of the millimeter wave energy is coupled to the output waveguide, to enhance efficiency, the aperture is dimensioned so that it substantially prevents propagation of the millimeter wave energy. It has been found that the wave cannot propagate through the aperture if it propagates along the axis in the $TE_{0,n}$ circular mode, and if the aperture has a circular cross section and a diameter so that it does not propagate a $TE_{01}$ mode.

In accordance with a further feature of the invention, the output waveguide is positioned so that it does not interfere with a relatively massive structure that establishes a DC magnetic field that causes the electrons of the beam to follow helical paths. Because it is necessary for the deflecting surface to be immediately downstream of a cavity or waveguide where interaction occurs between the beam and the field, and this region is approximately in the center of the DC magnetic field, where it is inconvenient to insert the output waveguide, to enable the output waveguide to be coupled to the deflecting surface, second and third additional reflecting surfaces are positioned to be responsive to the wave reflected from the reflecting surface coaxial with the beam axis. All three reflecting surfaces are slanted 45° relative to the beam axis, with the third surface positioned considerably downstream from the other two surfaces and arranged so that the wave reflected from the third surface is coupled directly into the output waveguide.

It is, accordingly, an object of the present invention to provide a new and improved higher power gyro device, such as a gyrotron, gyroklystron or gyro travelling wave tube.

Another object of the invention is to provide a high power gyro device wherein r.f. energy is more conveniently coupled from an interaction region to an output waveguide.

An additional object of the invention is to provide a new and improved high power gyro device wherein the output waveguide is physically and electrically decoupled from an electron beam collecting region.

An additional object of the invention is to provide an improved high power gyro device which enables an extremely large collector to be achieved without affecting the microwave output characteristics of the device.

A further object of the invention is to provide a high power gyro device wherein problems associated with large gradient millimeter wave fields and secondary emission in the collector region do not exist to limit the output power of the device.

Still another object of the invention is to provide a new and improved high power gyro device wherein an output waveguide is physically removed from an electron beam collector, as well as from a relatively massive structure for establishing a DC magnetic field which establishes relatively straight lines of flux throughout an interaction region between a hollow electron beam and an oscillating r.f. field.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWING

Figure 1:
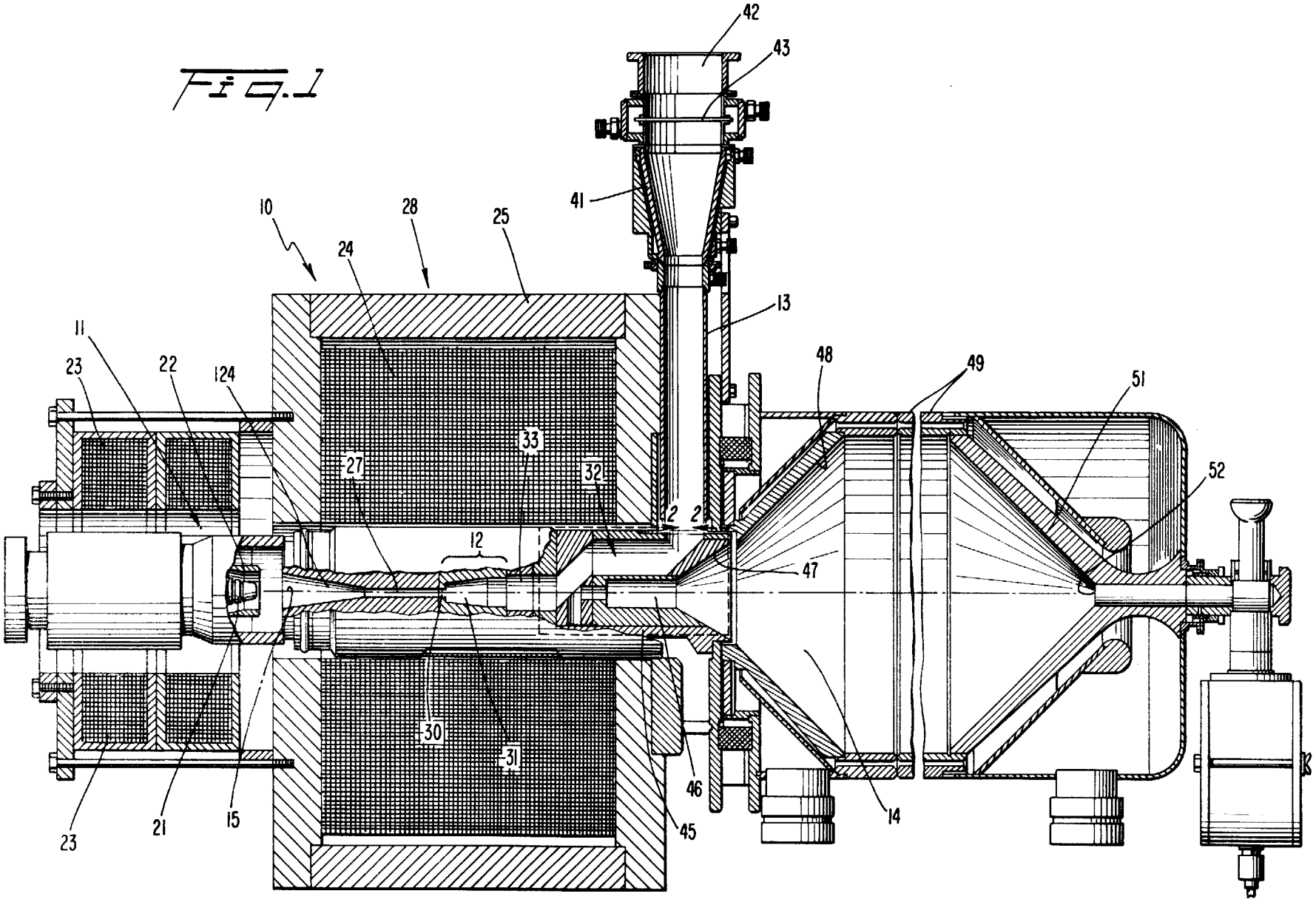
FIG. 1 is an overall view of a preferred embodiment of a gyrotron including the invention.

Reference is now made to FIG. 1 of the drawing wherein there is illustrated a gyrotron vacuum tube 10 including electron gun assembly 11, electromagnetic wave interaction region 12, an output waveguide 13, that is disposed at right angles to the longitudinal, aligned axes of gun 11 and interaction region 12, as well as electron beam collector 14, having a longitudinal axis aligned with common axis 15 of gun 11 and interaction region 12. Electron gun assembly 11 and interaction region 12 are of conventional structure and therefore are only broadly described.

Electron gun 11 includes an annular cathode 21 from which electrons are radially and axially ejected in response to an electron beam accelerating DC electric field established by anode 22; anode 22 and cathode 21 are both coaxial with axis 15. Typically, cathode 21 is biased at −80 kilovolts, while a −55 kilovolt accelerating potential is applied to anode 22. A DC magnetic field is established along axis 15 through cathode 21 and anode 22 by solenoid coil 23 that is concentric with axis 15 and energized by a suitable DC power supply voltage. An interaction between the DC electric fields applied between cathode 21 and cathode 22 and the magnetic field established by solenoid coil 23 causes a hollow, spiralling electron beam to be derived from gun assembly 11. A gun of this general type is described in U.S. Pat. No. 3,258,626 issued June 28, 1966 to G. S. Kino and N. J. Taylor and assigned to the assignee of the present invention.

The hollow electron beam is accelerated into interaction region 12, through a grounded, tapered, annular anode electrode 124 whose bore 27 is cut off for the millimeter waves in their generated mode. A high intensity DC magnetic field is established along axis 15 in interaction region 12 by a magnetic assembly including DC energized solenoid coil 24 and high magnetic permeability yoke 25, both of which are coaxial with axis 15. The magnetic field intensity established by coil 24 and yoke 25, in combination with the electric field intensity established between anode electrode 124 and cathode 21, is sufficiently great to cause the hollow electron beam derived from cathode 21 to gyrate at a relativistic electron cyclotron frequency near the millimeter wave frequency at which tube 10 is operated. The cyclotron action causes each electron to gyrate in a small helical path in synchronism with the millimeter wave. The interaction of the electrons with the transverse electric wave in region 12, in a direction generally perpendicular to axis 15, causes the electrons to be bunched in azimuth angle with respect to the axis of each individual electron helix axis and hence to give up energy to the transverse electric wave while the beam propagates through region 12. In gross cross section, the beam can be visualized as an annulus. This action is described in the previously mentioned prior art, and in particular in the article by Symons et al.

The interaction region 12 can be a single resonant cavity as shown in which a millimeter wave is induced preceded by a cut-off region 27. Alternatively, it can be a plurality of resonant cavities separated by cut-off drift regions similar to bore 27, the first cavity of which is excited by an external millimeter wave source, or it may be a continuous waveguide; these structures are referred to as gyrotrons, gyroklystrons, and gyro travelling wave tubes, respectively. In addition, interaction region 12 can be a combination of the resonant and travelling wave tube devices, as well as other interaction structures, such as waveguides propagating a wave in a direction toward the cathode (gyro-backward wave tubes). In such a case one of several obvious rearrangements of the 45° reflecting surfaces and waveguide would have to be made as described hereinafter.

In the illustrated embodiment, millimeter waves induced in the interaction cavity 12 by the electron beam, in one embodiment having a 28 GHz frequency, and having field of the configuration of the cylindrical $TE_{0,n}$ mode, are coupled into highly conductive, metal miter box 32 where the wave is deflected away from axis 15 and into output waveguide 13, while the beam continues to propagate along axis 15 to collector 14.

Winding 24 and yoke 25 establish an extremely intense DC magnetic field throughout the entire region extending from the beam entrance end of anode 124 to the output end of interaction region 12. This extremely intense magnetic field causes the beam electrons to have a tendency to converge as they pass from the gun 11 through the tapered electrode 124 and follow helical paths through the interaction region 12. Because of the relatively massive structure of winding 25 and yoke 26, it is desirable for output waveguide 13 to be longitudinally displaced from the winding and yoke. For the gyrotron, wherein the electron beam and wave travel in the same direction, waveguide 13 is downstream of interaction region 12; however, if a backward wave interaction region were employed, wherein the electron beam and wave travel in opposite directions, the output waveguide would be at the electron beam inlet end of interaction region 12, or the beam might enter through the interaction region 12 through a 45° angle wave-deflecting surface and the waveguide 32 would parallel the interaction region 12 over its full length.

Figure 2:
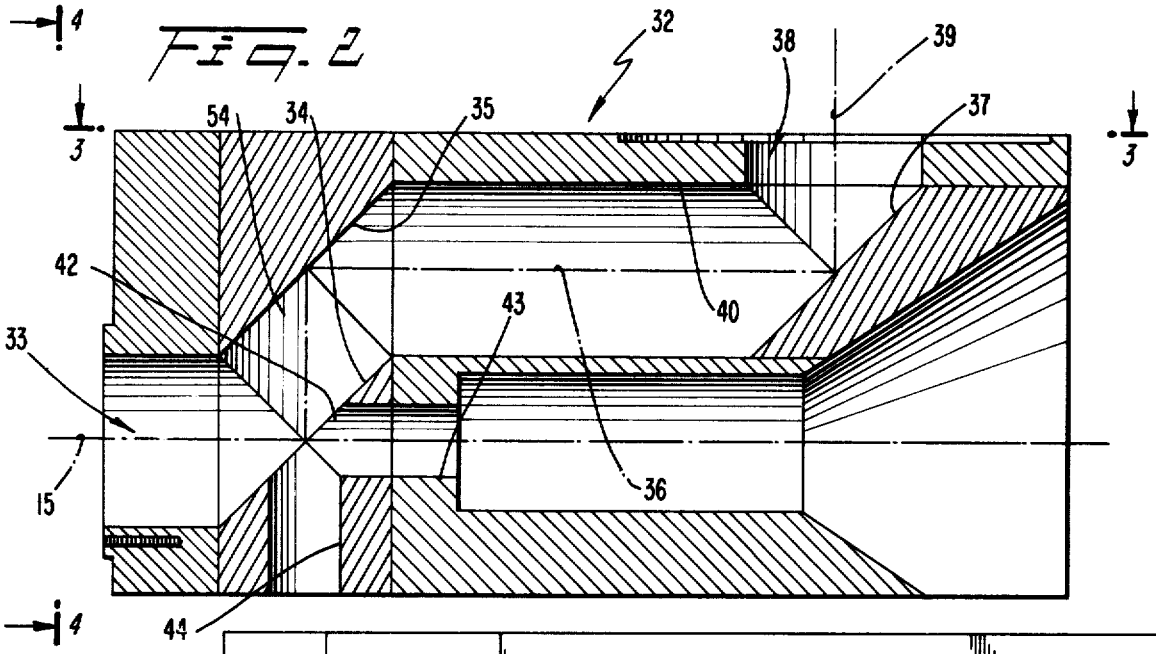
FIG. 2 is a side sectional view of a structure for deflecting a millimeter wave produced as delineated by 2—2 in FIG. 1.
Figure 3:
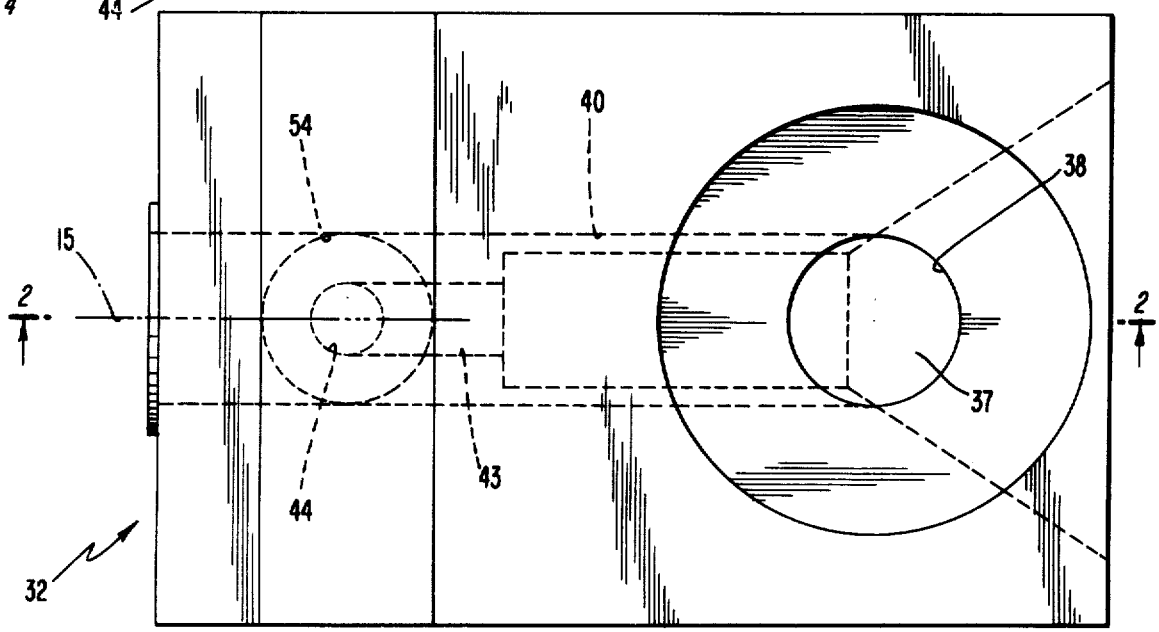
FIG. 3 is a front view of the structure illustrated in FIG. 2.
Figure 4:
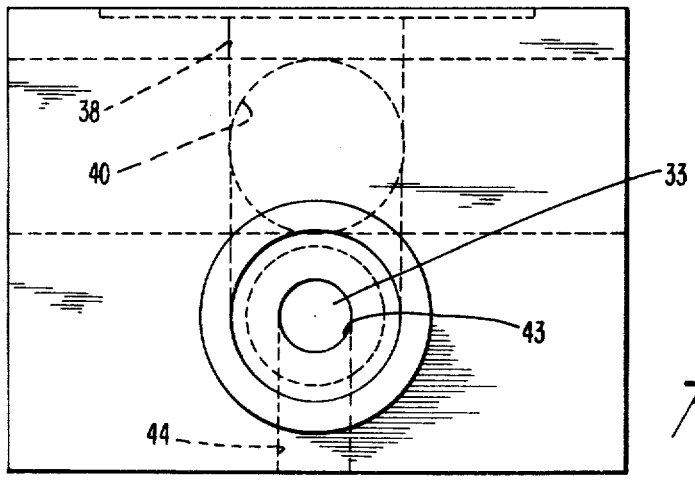
FIG. 4 is a top view of the structure illustrated in FIG. 2.

To couple the on-axis electron beam to collector 14 and the off-axis millimeter wave to output waveguide 13, which is at right angles to axis 15, miter box 32 is preferably constructed as illustrated in FIGS. 2–4. The miter box is formed as a right parallelpiped having cylindrical input waveguide 33 that is coaxial with axis 15. Waveguide 33 has a radius sufficiently large to propagate the $TE_{0,n}$ wave propagating out of cavity 12. Waveguide 33 is thus larger in diameter than cavity 12, which latter is essentially at cut-off for the operating mode. Thus there is some beamwave interaction in waveguide 33, but it is weak because the travelling-wave fields are much lower than in resonant cavity 12. Waveguide 33 is terminated by a polished, metal reflecting planar face 34 that is inclined 45° relative to axis 15 so that the $TE_{0,n}$ wave impinging thereon is reflected upwardly into a second vertical waveguide 54 and onto a second reflecting, face 35, having a center displaced from axis 15 and lying along horizontal, longitudinal axis 36 for cylindrical waveguide 40. A third reflecting face 37, at the end of waveguide 40, is displaced along axis 36 from face 35 and lies in a plane parallel to face 35 so that the wave energy reflected horizontally by face 35 is reflected vertically, in an upward direction from face 37. Face 37 has an elliptical shape having a center that defines the vertical, longitudinal axis 39 of cylindrical bore 38; axis 39 is coincident with the longitudinal axis of cylindrical output waveguide 13. Waveguide 13 is terminated with an outwardly flared section 41 (FIG. 1) that couples the energy propagating through waveguide 13 to an enlarged cylindrical output waveguide 42 having a radiation transparent, vacuum window 43 therein.

Each of the cylindrical waveguides within miter box 32 in the path including waveguide 40 between cylindrical input cavity 33 and cylindrical output cavity 38, is dimensioned so that it is not cut off for the millimeter wave energy propagating in the $TE_{0,n}$ mode at the output of cavity 12. In one preferred embodiment, each of these cylindrical waveguides has a diameter of 1.137" to propagate a $TE_{02}$ wave having a frequency of approximately 28 GHz.

To couple the electron beam emerging from output cavity 12 to collector assembly 14, reflecting face 34 has an aperture 42 therein which leads to bore 43; both aperture 42 and bore 43 are coaxial with axis 15 and have the same diameter which prevents propagation into bore 43 of the $TE_{0,n}$ wave fed in cylinder 13. In other words, aperture 42 and bore 43 are dimensioned so that the cutoff frequency associated with them is greater than the $TE_{0,n}$ wave propagating in waveguide 33. In the previously discussed preferred embodiment, bore 43 has a diameter of 0.438" Bore 43 has sufficient length to prevent any r.f. energy that might get trapped therein from being coupled into collector assembly 14.

At right angles to axis 15 and extending vertically in the downward direction, is a further bore 44, having the same diameter as bore 43. Bore 44 under some conditions may reduce the excitation of waveguide modes other than the $TE_{0,n}$ mode in which propagation is desired. However, the presence or absence of bore 44 is not critical to the successful operation of a gyro device employing this invention. In the specifically described embodiment, the match between waveguide 33 and the output waveguide 13 remains relatively good, so that there is a voltage standing wave ratio of less than 1.2, even though circular aperture 42 is larger than the first E-field maximum of the $TE_{0,n}$ wave in interaction region 12. For $TE_{0,1}$ waves, it was necessary to make the diameter of waveguides 33, 38, 40 and 54 nearly large enough to propagate the $TE_{02}$ waves to obtain a good match. However, for $TE_{02}$ and higher $TE_{0,n}$ modes in drift region 12, the only requirement seems to be that aperture 42 not propagate a $TE_{01}$ mode.

After the electron beam has propagated through bore 43, it enters a transitional, outwardly extending, flared cylindrical region 46 (FIG. 1) which transmits the beam from bore 43 into collector assembly 14. Collector assembly 14 includes two outwardly flared sections 47 and 48, both of which are concentric with axis 15. At the end of flared section 48, collector 14 is formed as a cylinder 49 having a relatively large diameter and extensive length. At the end of cylinder 49 is a conical section 51, having an apex 52 that is connected to ground through a relatively low resistance, such as one ohm, that is responsive to approximately an 8 ampere collector current.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A high power gyro device wherein beam electrons follow helical paths imposed by a DC magnetic field and the angular velocity is modulated as the beam passes through an oscillating r.f. field of an interaction region so that a high power electromagnetic wave generally of TE modes is established in the region as a result of an interaction between the beam and the field, said wave and beam travelling along the same longitudinal axis, a collector for the beam, and an output waveguide for the wave, the improvement comprising: a conductive surface having an aperture therein and positioned upstream of said collector for substantially reflecting said wave away from said longitudinal axis to the output waveguide while enabling the beam to travel to the collector.

2. The device of claim 1 wherein said conductive surface substantially prevents propagation of said wave into said collector.

3. The device of claim 1 wherein the wave propagates in the $TE_{0,n}$ mode, said aperture being dimensioned so that it does not propagate in a $TE_{01}$ mode.

4. The device of claim 1 wherein the wave propagates in the $TE_{0,n}$ circular mode, said aperture having a circular cross section perpendicular to said axis and a center on said axis and a diameter so that it does not propagate a $TE_{01}$ mode.

5. The device of claim 1 wherein the reflecting surface is a plane coaxial with the beam axis and slanted 45° relative to the axis.

6. The device of claim 1 wherein the output waveguide has a longitudinal axis at right angles to the wave and beam axis and is positioned externally to a means for establishing the DC magnetic field, the deflecting means further including a second planar reflecting surface positioned to be responsive to the wave reflected from the reflecting surface coaxial with the beam axis, said second surface being slanted 45° relative to the beam axis, a third planar reflecting surface positioned to be responsive to the wave reflected from the second reflecting surface, said third surface being slanted 45° relative to the beam axis and positioned so the wave reflected from it is coupled directly into the output waveguide.

7. A high power gyro device comprising means for deriving a beam of electrons following helical paths, said beam having a longitudinal axis, said means including means for applying DC electric and magnetic fields to the beam, said DC electric and magnetic fields being directed along the axis, means for modulating the angular velocity, said modulating means including means for establishing an oscillating r.f. field in an interaction region through which the beam propatates so that a high power electromagnetic wave generally of TE modes is established in the region as a result of an interaction between the beam and said r.f. field, said high power wave and beam both travelling in the interaction region along the longitudinal axis, a collector for the beam positioned on the axis, and means upstream of the collector for reflecting the wave away from the axis to the output waveguide while enabling the beam to travel along the axis to the collector.

8. The device of claim 7 wherein the means for reflecting the wave while enabling the beam to travel to the collector comprises a conductive surface for reflecting the wave away from the axis, said surface having an aperture for passing the electron beam to the collector while substantially preventing propagation of the wave.

9. The device of claim 8 wherein the wave propagates in the $TE_{0,n}$ mode, said aperture being dimensioned so that it does not propagate a $TE_{01}$ mode.

10. The device of claim 8 wherein the wave propagates in the $TE_{0,n}$ circular mode, said aperture having a circular cross section perpendicular to said axis and a center on the axis and a diameter so that it does not propagate a $TE_{01}$ mode.

11. The device of claim 8 wherein the reflecting surface is a planar surface coaxial with the beam axis and slanted 45° relative to the axis.

12. The device of claim 7 wherein the output waveguide has a longitudinal axis at right angles to the wave and beam axis and is positioned externally to the means for establishing the DC magnetic field, the deflecting means further including a second planar reflecting surface positioned to be responsive to the wave reflected from the reflecting surface coaxial with the beam axis, said second surface being slanted 45° relative to the beam axis, a third planar reflecting surface positioned to be responsive to the wave reflected from the second reflecting surface, said third surface being slanted 45° relative to the beam axis and positioned so the wave reflected from it is coupled directly into the output waveguide.

13. A high power gyro device wherein a high power electromagnetic wave is established with a field configuration generally of TE modes in a region where beam electrons following helical paths along a longitudinal axis in the presence of a DC magnetic field interact with an oscillating r.f. field while both said r.f. wave and said beam electrons travel along said axis and the angular velocity of said beam electrons is modulated, said device comprising a collector for said beam electrons, an output waveguide positioned off said axis, and a wave-reflecting surface positioned on said axis and upstream of said collector, said surface having an aperture so that said beam electrons pass through said surface into said collector, said aperture being so shaped and dimensioned that said wave in $TE_{01}$ mode is prevented from propagating into said collector.

14. The device of claim 13 wherein said aperture has a circular cross section perpendicular to said axis and centered on said axis.

15. The device of claim 13 wherein said output waveguide is positioned at right angles to said axis.

16. The device of claim 15 wherein said wave-reflecting surface is a planar surface coaxial with said longitudinal axis and slanted 45° to said axis.

17. The device of claim 16 further comprising a second planar wave-reflecting surface positioned to be responsive to the wave reflected from said wave-reflecting surface positioned on said axis, said second surface being slanted 45° relative to said longitudinal axis, a third planar reflecting surface positioned to be responsive to the wave reflected from said second surface, said third surface being slanted 45° relative to said longitudinal axis and positioned so the wave reflected from said third surface is coupled directly into said output waveguide.

18. The device of claim 13 wherein said output waveguide has a radius sufficiently large to propagate a $TE_{02}$ wave.

* * * * *